US005222901A

United States Patent [19]

Burkenpas

[11] Patent Number: 5,222,901

[45] Date of Patent: Jun. 29, 1993

[54] REDUNDANT MARINE ENGINE CONTROL SYSTEM

[75] Inventor: Richard W. Burkenpas, Lynwood, Wash.

[73] Assignee: Marine Brokers, Inc., Seattle, Wash.

[21] Appl. No.: 671,034

[22] Filed: Mar. 18, 1991

[51] Int. Cl.[5] ..... B60K 41/00

[52] U.S. Cl. ..... 440/86; 440/87; 74/480 B; 74/DIG. 8

[58] Field of Search ..... 440/86, 87, 84; 244/228, 236; 74/480 B, DIG. 8; 114/150

[56] References Cited

U.S. PATENT DOCUMENTS

| | | | |
|---|---|---|---|
| 2,604,613 | 7/1952 | Klass | 244/228 |
| 3,080,721 | 3/1973 | Mett et al. | 114/150 |
| 4,004,537 | 1/1977 | Nilsson | 244/236 |
| 4,836,809 | 6/1989 | Pelligrino | 440/87 |
| 5,056,379 | 10/1991 | den Ouden | 74/480 B |
| 5,080,619 | 1/1992 | Uchida et al. | 440/87 |

*Primary Examiner*—Sherman Basinger
*Assistant Examiner*—Thomas J. Brahan
*Attorney, Agent, or Firm*—Harry M. Cross, Jr.

[57] ABSTRACT

This invention relates in general to an electro-mechanical engine control system configured in such a manner as to provide redundant engine controls for marine engines. Microprocessor based, electronic controlled mechanical servos and an electro-mechanical transferring apparatus, facilitates the integration of the electronic control system with mechanical engine controls as they are known to the marine industry of today. This combination of electronic engine controls, integrated with clutch driven servos and mechanical transferring mechanism provides the operator of any marine craft the ease of operation of electronic controls with the security of mechanical backup operation in case of power or system failure.

12 Claims, 11 Drawing Sheets

REDUNDANT MARINE ENGINE CONTROL SYSTEM

FIELD OF THE INVENTION

This invention relates to engine throttle and shift control systems, and particularly to such systems intended for control of marine engines.

BACKGROUND OF THE INVENTION

This invention relates in general to an electro-mechanical engine control system which, when integrated with a manually operated mechanical engine control system will provide the vessel with two independent or redundant engine controls. The objective of the disclosed electro-mechanical engine control system is to eliminate the difficulty encountered when installing and operating existing multiple station engine controls. In addition, the disclosed system is expandable to any number of control stations, yet provides two independent control systems for the security of operation.

The disclosed engine control system provides redundancy in case either engine control system should fail. With the back up features of this disclosed engine control system, the unique mechanical transfer mechanisms located in both the control head and servo facilitates the immediate transfer from one engine control means to the other engine control means therefore greatly reducing possible hazards.

Those engine control systems used today, such as standard mechanical push-pull cables, hydraulics or pneumatic engine controls are prone to possible failures, are difficult to install and in the case of hydraulic and pneumatic engine controls are expensive to purchase. When a failure occurs in today's art of engine control the vessel's operator is left without the means to control the craft.

When operating mechanical push-pull cables, the inner core can fray and bind in the outer sheath or in some cases simply break. When this occurs, the cables are inoperable and engine control is interrupted. When installing push-pull cables one must consider the length of cable, as long cable runs will make the controls difficult to operate. Only two control stations can be installed on most vessels because a third station will make the controls too difficult to operate.

With hydraulic engine controls, installation time is extensive and should the systems lose pressure or develop a fluid loss, the system will fail and become inoperable. Hydraulic engine controls are expensive to install on boats less than thirty feet and are difficult to operate on boats over sixty feet.

The loss of air in a pneumatic engine control system, whether this is caused by a broken line or a compressor failure, will render the system inoperable. Initial purchase cost of a pneumatic engine control system is extremely high, while installation time and repair cost is extensively higher than other types of engine controls. Even though cost is high, pneumatic engine controls are the only type of engine controls available today that will operate properly on vessels over ninety feet in length.

Any type of failure in a single element, non-redundant engine control system will leave the operator without engine control and, therefore, in a situation where liabilities are high. Even the more modern electronic engine controls demonstrate the same failure mode, viz. no engine control after system failure or loss of power.

With this invention's disclosed redundant capabilities, engine control is automatically switched from manual to electronic engine control and back, if necessary, keeping the operator in control of the vessel at all times.

Other mechanical transfer mechanisms may accomplish the same function, however they must be manually operated. They are generally located in one location only, usually in the main pilot house and the engine must be in neutral and idle before the transfer can be completed. In contrast, the present disclosed method of transfer provides for transfer of operation or shut down at any period of time or engine condition.

SUMMARY OF THE INVENTION

The electro-mechanical engine control system for marine engines of this invention provides a redundant engine control for the shift and throttle functions wherein said system provides servo motor control for each function and where each of said functions are mechanically backed up by push pull cables and coupled into said system by an electro-magnetic clutch. An electro-mechanical conversion unit allows the conversion of mechanical ship-board control stations into electronic control stations where said stations integrate with the system. This electro-mechanical conversion mechanism converts any manual control station into an electronic control station when the system power is on and automatically switches back to manual push-pull control when power is switched off.

Accordingly, a general objective of the present invention is to combine a microprocessor based electronic controller with an electro-mechanical transferring mechanism to form an engine control system that provides a marine vessel with two independent engine control systems which, when integrated together form a redundant engine control system.

An objective of this invention is to provide a redundant engine control system that displays the same look, feel and operation of a standard configured manual lever engine control used today.

Another objective of the present invention is to provide for the possible conversion of any existing manually operated mechanical engine controls into electronic or electro-mechanical redundant controls.

A further objective of the present invention is to provide a remotely operated servo apparatus which, when instructed will energize and integrate itself into the existing mechanical engine throttle control mechanism, facilitating remote throttle control.

Still another objective of the present invention is to provide for a remotely operated servo apparatus which, when instructed will energize and integrate itself into the shift control mechanism facilitating remote shift control.

An additional objective of this invention is to provide an electronic feedback from within the servo to provide the microprocessor with the exact position of the engine's controls, facilitating position tracking for transferring to and from one or the other method of engine control.

A further objective of this invention is to provide an electro-mechanical apparatus which, when the integrating clutch is de-energized will provide manual mechanical engine control with minimal drag or resistance to the manual movement of the engine controls.

An additional objective of this invention is to provide an electro-mechanical apparatus which requires only one input means, either electronic or mechanical and converts said singular input means into two mechanical outputs, one for shift and one for throttle, yet maintains mechanical backup.

Still a further objective of this invention is to provide a means to convert remote electronic commands into mechanical linear motion; thus moving mechanical engine levers such as throttles, governors and transmission shift levers.

A more specific objective of this invention is the ability of the servo to mechanically back drive manual controls thus tracking the electronic command from the electronic lever control. This tracking provides instant conversion from electronic to mechanical engine control.

A further objective of this invention is to provide the capability to install this control system on any size of vessel, with any number of control stations.

Other objectives, advantages and distinctions of the present invention over prior art will become apparent from the following description taken in conjunction with the accompanying drawings.

DETAILED DESCRIPTION OF THE INVENTION

In its general construction, the present invention is comprised of 5 basic assemblies which are: (1) an electro-mechanical servo/controller; (2) an electronic control head; (3) a mechanical to electronic conversion apparatus; (4) an electro-mechanical transfer mechanism; (5) an on/off control panel.

Figure 1:
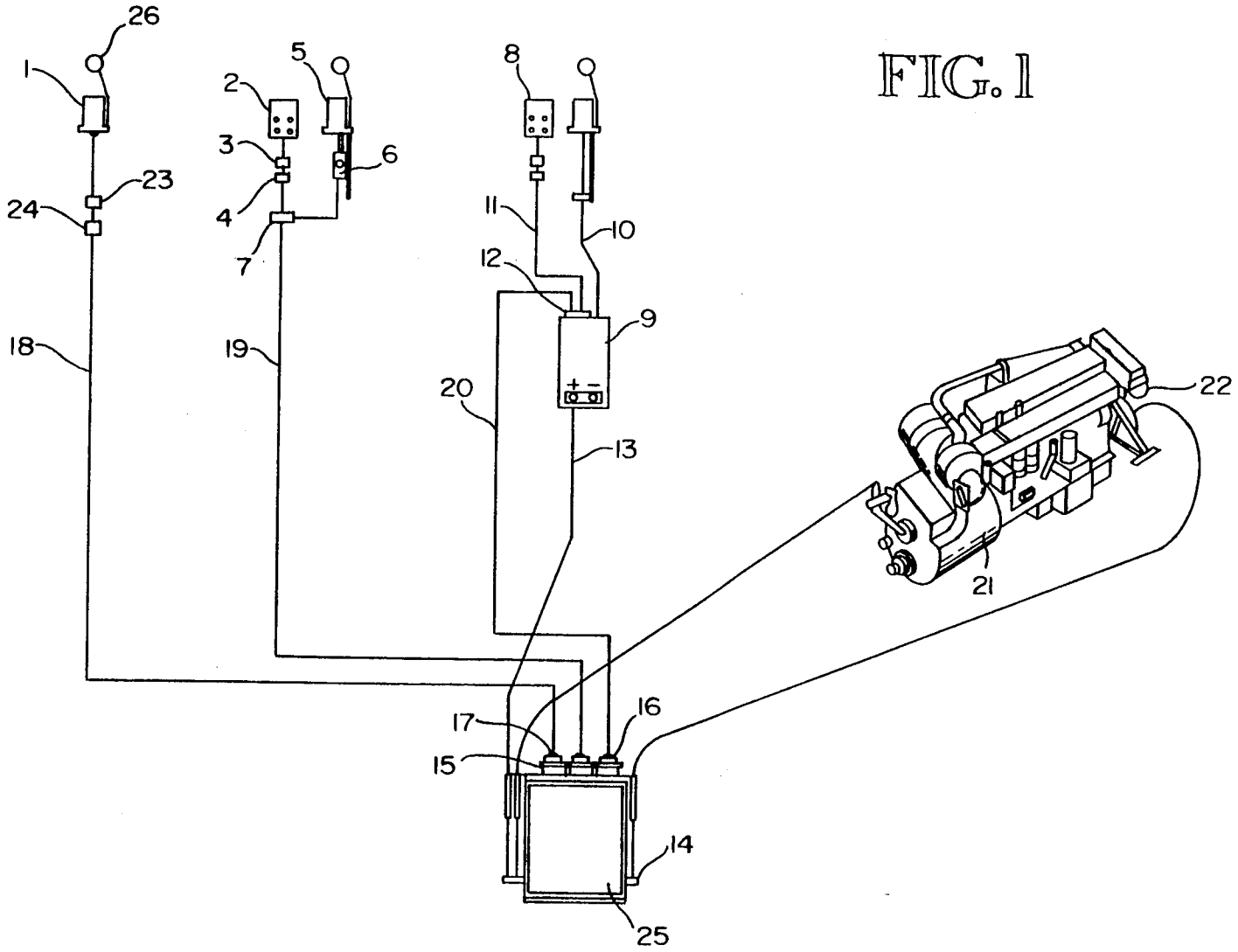
FIG. 1 shows a pictorial illustration of the disclosures redundant engine control system.

Of the foregoing and referring to FIG. 1, there is seen a pictorial illustration of a typical marine engine configured with a redundant engine control system. As shown in FIG. 1 there are five different assemblies which make up the total electronic control system. The system has been configured to demonstrate a single lever electronic control head defined as item 1 and illustrates its connection into the system. The illustration further demonstrates how a standard single lever control head, shown as item 5, is converted into an electronic conversion apparatus, item 6, while using a separate on/off panel.

FIG. 1 further illustrates a third standard control head item 8, which has a short push-pull cable attaching the control head to a unique electro-mechanical transferring mechanism, item 9. A second cable is attached to the output of the transfer mechanism and routed to the controller and electro-mechanical servo mechanism item 25, to form one leg of the redundant element of this disclosure.

To complete the system, a cable is attached to the engine's transmission shift mechanism control arm and is then routed to the mechanical servo where it is attached to the shift output arm. This cable forms the electronic and the manual redundant shift for the engine. An additional cable is attached to the engine's throttle mechanism arm by the standard means and is routed back to the mechanical servo of 25 where it is attached to the throttle output arm in a standard manner. This forms the electronic and the manual redundant throttle control for the engine's speed.

Further reference to FIG. 1 shows the controller and electro-mechanical servo mechanism (25), which contains the controlling microprocessor, the drive electronics, mechanical gearhead, motor and clutch mechanisms. The controller has been designed to accept a plurality of electronic input commands and converts these commands into mechanical motion to mechanically move the engine's shift and speed control mechanisms. One of the inputs, the electronic control head, outputs an electronic DC signal which corresponds to the angular position of the lever attached to the control head.

Contained within the electronic control head is the shift and throttle detent, drag and a position potentiometer which converts the angular lever position into a dc voltage. The electronic control heads are connected to the electronic controller and conversion servo mechanism by means of electronic cables.

Figure 7:
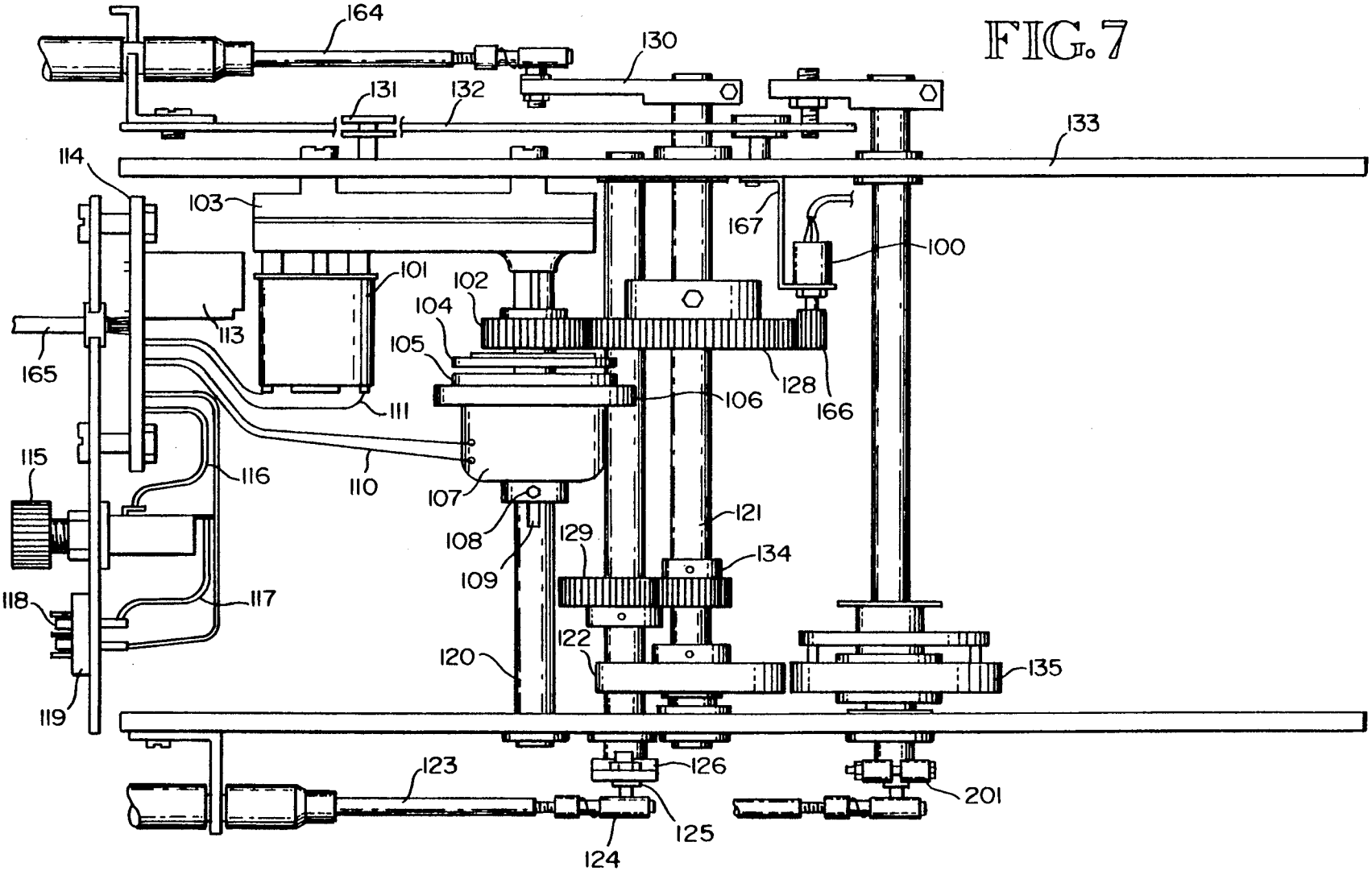
FIG. 7 shows a pictorial view of the electro-mechanical servo mechanism illustrating the clutch and it's associated gears and cams.

Referring to FIG. 7, the construction of the controller/servo mechanism, there is displayed a small yet strongly constructed enclosure which has been designed and constructed of aluminum to give the servo mechanism minimum weight with maximum flexibility for the installation of the necessary motors, gears, shafts and electronics to facilitate a closed loop engine control system.

The means to convert electronic drive commands from the control head into mechanical motion is accomplished by a microprocessor and associated circuits. The microprocessor controlled power amplifier drives the permanent magnet motor or stepper motor and a gearhead. The output torque of the permanent magnet motor is approximately 110 ounce inches torque. The motor output is 3200 RPM and is coupled through a 457:1 gearhead. In FIG. 7, the combined motor and gearhead are illustrated and the motor is configured such that it will deliver through the gearhead approximately 250 inch pounds of rotational torque to the output shaft at a speed of 7 RPM. While the motor is secured with four bolts, the output shaft of the motor is supported in a roller bearing pressed in the opposite support side of the housing. A bearing mounted clutch is pressed and keyed to the output shaft of the gearhead. The bore of the armature of said clutch contains a bearing which carries the side load and provides the non-drag or non-resistive load to the manually operated mechanical engine controls when the system is powered down. The remaining sections of the clutch, the rotor, field and coil are positioned and keyed to the output shaft of the motor. A 28 tooth spur gear is pressed to the splined hub of the armature. The armature is slid over the gearhead output shaft and spaced to align with the 60 tooth driven gear. The 60 tooth driven gear allows the output torque to be multiplied by 2:1. With the clutch installed the motor and gearhead are bolted to the left side panel which has been previously bolted to the bottom plate. In a mechanical engine control system, the output shaft and the pressed on driven gear are positioned in the left side bearing. The design is such that the 2.64 inch diameter clutch delivers a static torque of 125 inch pounds.

The output torque of the clutch is approximately one-half of the output torque of the gearhead motor combination, thus enabling the motor to reach full RPM under a heavy load condition. This torque and speed assures that the operator will always have a 0.45 second shift time for a quick shift speed. The output torque of the clutch is such that sufficient rotational torque is available to operate either the shift or the throttle function and still have sufficient torque to push or pull the single, manually operated engine control cable, thus facilitating said invention's redundant engine controls capabilities.

As defined above, in some installations it may be necessary for the servo mechanism to not only control an element of the engine's operation, but also back drive the manual control levers at the helm. This reverse operation of the manual controls provides visual monitoring of the shift and throttle operation. The output torque of the servo's clutch has been designed and tested so that it will not damage push-pull cables, valves or hydraulic cylinders controlled by the gearhead clutch combined drive.

Should a hydraulic servo be required a slave hydraulic cylinder is mounted in place of the mechanical output shaft. The driven gear that was pressed to the output shaft is in turn pressed on the shaft of the slave cylinder and keyed into position. The slave cylinder is then bolted to the left side panel.

In both cases the driven gear is aligned with the pinion gear pressed on the clutch. The right panel is brought onto position to support the gearhead shaft and is bolted to the bottom plate. The feedback potentiometer, mounting bracket and spur gear are mounted to the right panel and the spur gear is meshed with the driven gear.

On the controller/servo mechanism, the arms that move the push-pull cables are attached to the output shafts on the outside of the panel. The arms are keyed and clamped to the output shaft to provide the ease of interconnecting with standard push-pull cable that are used in the marine industry.

BEST MODE FOR CARRYING OUT THIS INVENTION

Referring to the drawings, wherein like numerals refer to like parts, there is seen in FIG. 1 an illustration depicting the disclosure's redundant engine control system. Exemplified are the basic elements of this disclosure to provide throttle and shift control of a standard marine engine. A plurality of engine control heads are shown to demonstrate their configuration and adaptation to use within the disclosed redundant engine control system.

The electronic control head generally designated by the number 1, FIG. 1 is an integrated control head wherein the electronic parts required to convert rotational manual movement of the lever arm 26 into a proportional DC voltage and to activate said system, is contained as a single element electronic control head 1. The internal configuration of control head 1 is shown by cut away illustration, FIG. 2. The control lever arm 38 is manually moved by the operator of the vessel. This movement of the control lever 38, causes the shaft of position potentiometer 40 to rotate. Said lever movement is transferred by detent collar 39 which is pressed onto the shaft of potentiometer 40 and locked in position. Potentiometer 40 is mounted on mounting bracket 55 and secured to the control head housing 54. Securing mounting bracket 55 and its associated parts to the control head housing 54 allows pressing the control lever 38 onto detent collar 39 and securing in place.

Figure 3:
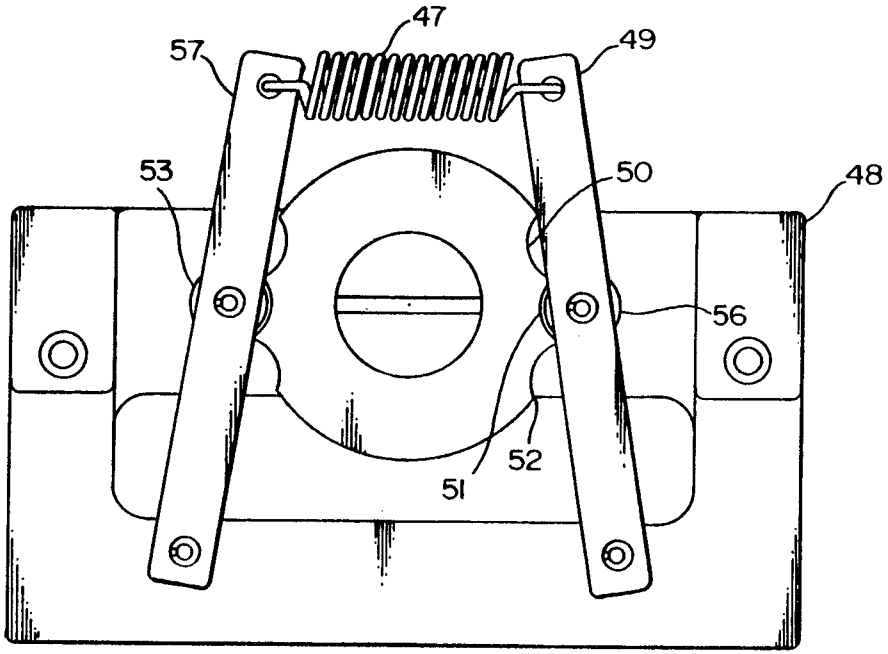
FIG. 3 shows a perspective view of the detent and cam operation of the manually operated electronic engine controls.

Referring to FIG. 3, a view of detent and potentiometer mounting bracket 48, detents 50, 51, and 52 are shown. Detent position 50 is the forward shift and engine idle position, while detent position 52 is the reverse shift and engine idle position. Detent position 51, is the neutral and idle detent position while detent rollers 53 and 56 provide rotational and holding force in each detent position. Detent pivot arms 57 and 49 and their respective pivot rollers are pressed into their respected detent position by the pressure exerted by detent spring 47. The force generated by detent spring 47, telegraphs the feel of each detent position to the control head lever. Detent position 51 is machined deeper and therefore requires greater force to move detent roller 53 and 56 from their respective neutral detent position. This heavier detent at neutral facilitates renegotiation of neutral position by feel.

Figure 2:
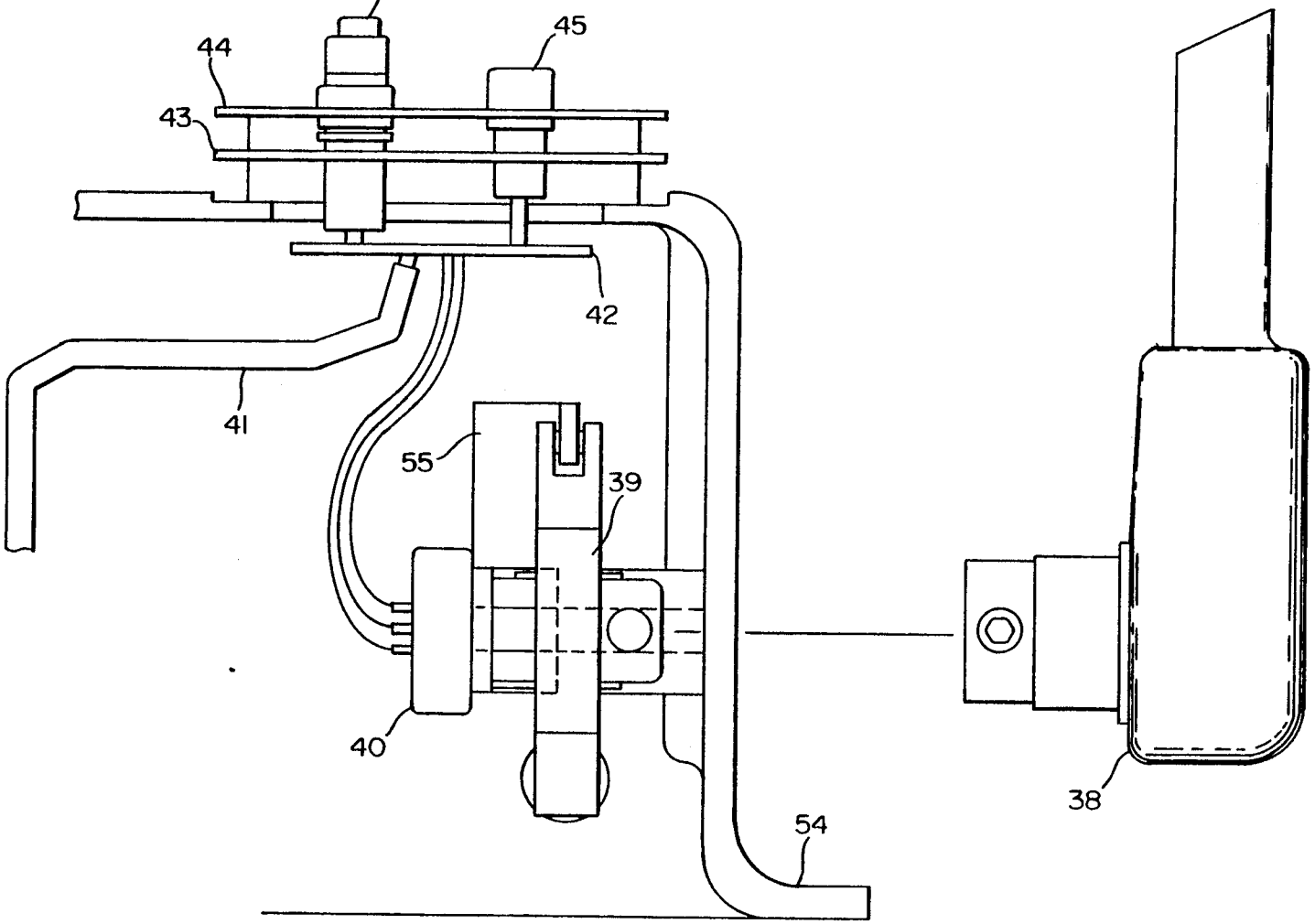
FIG. 2 shows a cut away view of the manual operated electronic control head.

Lever position potentiometer 40, FIG. 2 has attached to it three wires which are routed from said position potentiometer 40 to a panel printed circuit board 42. Printed circuit board 42 provides the interwiring between lever position potentiometer 40, on/off and activate switches 46, as well as power on and activate indicators 45. Switches 46 and indicators 45 are secured to control panel 44, which has gasket 43 adhered to seal out water. Control head output cable 41 is attached to printed circuit board 42 and provides the interconnect output from the control head. Attached to the control head output cable 41 is a male connector plug 23, as is shown in FIG. 1.

Electronic control head 1, FIG. 1, is connected to the electronic controller and mechanical servo mechanism 25 by means of interconnect cable 18. On the control head end of cable 18 is a waterproof male connector plug, 24 which will plug into female socket 23 and connect the control head 1 to cable 18. On the controller 25 end of cable 18 is "D" subminiature nine pin male connector 17. The male connector 17 mates to connector 15 to complete the interconnect of control head 1 to electronic controller and mechanical servo mechanism 25. This means of plug to plug connections assures correct wiring and grounding with ease of replacement.

Manual engine control heads, identified as items 1, 5 and 8, FIG. 1, are used by the marine industry to control the throttle or speed of the engine, as well as the transmission and shifting of the attached gearbox. To date, there are over 32 different styles and configurations of engine control heads.

Most of these different styles and configurations were designed to meet the needs of certain boat designs but in some situations meet only the need or desire of the user. One of the major objectives of this disclosure is to disclose and explain how to convert these existing manually operated, mechanical push-pull-cable control heads into electronic control heads, to control the engine's throttle and shift function, yet retain the existing control heads and still provide redundant engine control.

Manual control head 5, FIG. 1, is a control head of prior designs and exemplifies what is used on marine vessels to meet an end need. Control head 5, as is shown, will be converted into an electronic control head by means of conversion mechanism 6 described in this disclosure. The internal mechanism of control head 5 and the mechanical interconnecting linkage between control head 5, and conversion mechanism 6, are shown in a cut away illustration by FIG. 4.

Figure 4:
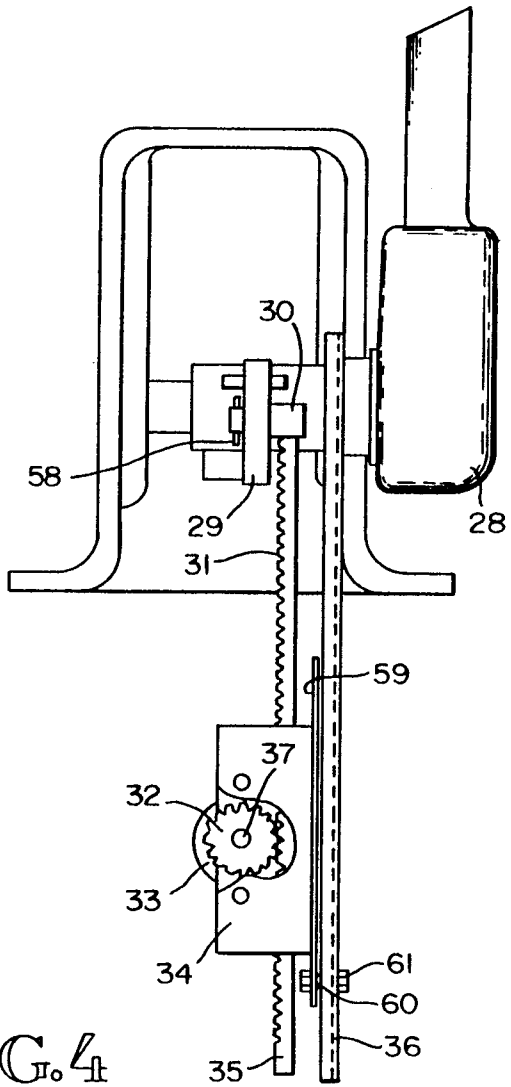
FIG. 4 shows a cut away view of the electro-mechanical conversion apparatus which allows mechanical to electronic conversion of any manually operated engine control head.

The configuration and size of the mechanical to electronic conversion mechanism 6, FIG. 1 has been designed to directly mount in place of the removed push-pull cables that may have operated the engine. As shown in FIG. 4, the conversion mechanism is integrated into the control head assembly by attaching said conversion mechanism mounting plate 59, to the existing control head cable hanger plate 36 by means of a shoulder bolt 60 and locking nut 61. Shoulder bolt 60 is inserted through an existing hole in cable hanger plate 36 and locking nut 61 is installed to secure the conversion mechanism. By using the same mounting hole that was used to mount the previously removed push-pull cables requires no modifications by the installer.

To attach the mechanical to electronic conversion mechanism to rocker arm 29, FIG. 4, a short threaded 10–32 rod, 31 has been used to facilitate any mechanical adjustments that may be necessary during installation. A cable mounting terminal 30 is threaded onto rod 31 and inserted into rocker arm 29. The cable mounting terminal is secured in place by cotter pin 58. The short piece of 10–32 rod 31 is, in turn, threaded into gear toothed rack 35. In operation, forward or reverse movement of control lever 28, FIG. 4, results in like rotation of rocker arm 29. This rotational movement is transferred by cable mounting terminal 30 as a linear movement through rod 31 into sliding gear rack 35. Mounting device 34 provides a guide for rack 35 as well as secures potentiometer 33 in alignment with gear rack 35. Spur gear 32 is pressed and secured to shaft 37 of potentiometer 33.

Figure 5:
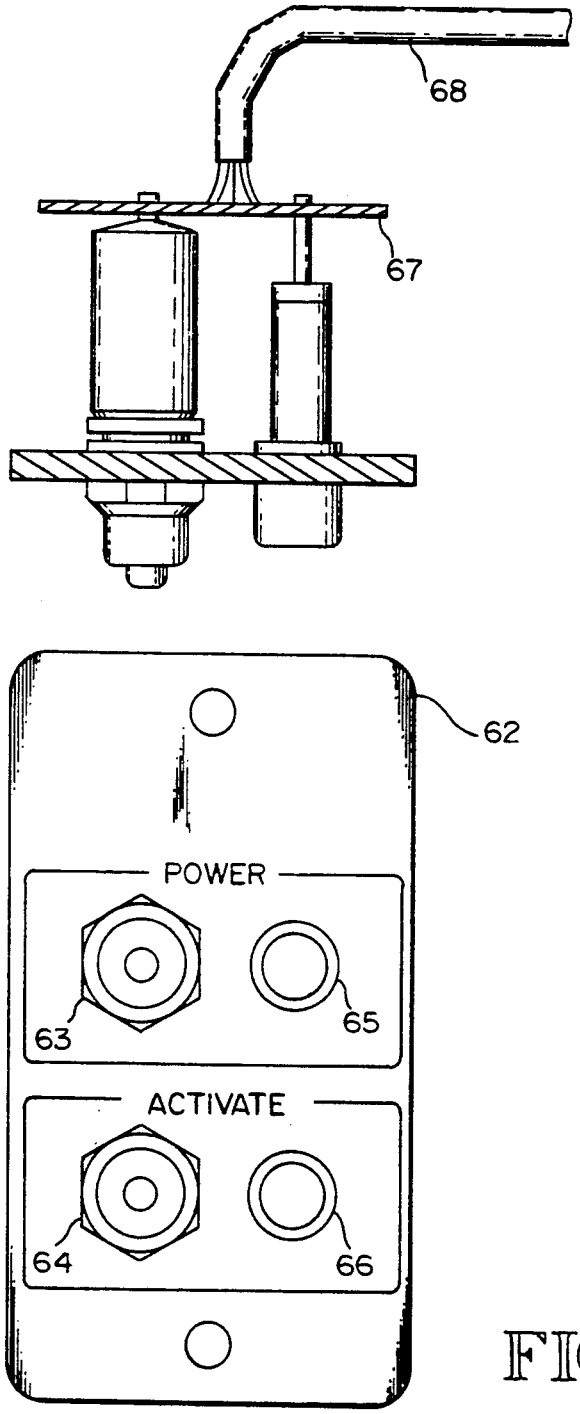
FIG. 5 shows a perspective view of the electronic lever control panel.

The linear movement of rack 35 will cause spur gear 32 to rotate, which in turn causes shaft 37 of potentiometer 33 to rotate to produce a DC voltage proportional to the angular rotation of lever arm 28. This proportional DC voltage is the signal that is converted by controller 25, FIG. 1 to command the servo to shift the transmission 21 or increase the throttle 22. The DC output voltage from the conversion mechanism 6, FIG. 1, is transmitted by the three conductor conversion cable 27, which is terminated at terminal strip 7. Referring to FIG. 5, there can be seen a control panel 62 which contains the on/off switch 63, an on/off indicator 65, an activate switch 64, and an activate indicator 66. All of the above items attach to printed circuit board 67 which acts as the interconnecting means between the switches, pots and cable 68. Cable 68 is the means of transmitting data from the control panel 62, to male connector 3, FIG. 1.

Male connector 3, FIG. 1 is inserted into female connector 4, to complete the interconnection to cable 19 which, in turn, terminates at terminal strip 7. At terminal strip 7 like wire colors are attached to like wire colors, wherein attached cable 19 is routed to the electronic controller and servo mechanism 25.

Referring to FIG. 1, there can be seen a third manual engine control head defined as item 8. While control head 8, is visually similar to control head 5 it will not be modified, but has attached to its internal rocker arm a 6 foot standard push-pull cable 10, in the normal manner as is practiced in the marine industry. The other end of cable 10 is attached to transfer mechanism 9.

Transfer mechanism 9 is one of the major objectives of this disclosure wherein this mechanism provides the capability for two independent engine control systems where one system is mechanical and the other system is electronic, thus forming a true redundant engine control system. In the down power mode of operation, shift and throttle engine control are accomplished manually through push-pull cables. In the up power or "on" mode of operation the mechanical transfer occurs and the shift and throttle engine control are accomplished electro-mechanically.

Referring to FIG. 1 and, as discussed, a standard engine control head, exemplified by item 8 is attached to the mechanical transferring mechanism 9, by means of a standard push-pull cable, exemplified by item 10.

In the down power mode of operation, such as loss of battery power, DC power will not be present and the engine control system must operate manually, not electronically. In this down power mode of operation, solenoid 75, FIG. 6, will be de-energized. With solenoid 75 de-energized, plunger 77 will be withdrawn from solenoid 75 by locking pin return spring 87.

Return spring 87 is attached to solenoid rocker arm 78 and the fixed pivot arm mounting bracket 81. Solenoid rocker arm 78 is held in place by rocker arm pivot pin 79 which is pressed through the U shaped pivot arm mounting bracket 81. Pivot arm mounting bracket 81 is bolted to input slider 73 as is solenoid mounting bracket 192. Mounting both of said brackets to the input slider 73 assures that locking pin 80 is aligned with bushing 89, which has been pressed through pivot mounting bracket 81, and one side of input slider 73. Bushing 89 and its alignment with locking pin engagement slot 88 has provided a nonrestrictive slide path which facilitates the ease of movement of locking pin 80 and assures that locking pin return spring 87 drives locking pin 80 into engagement slot 88 when power is lost. Likewise, said alignment facilitates ease of extracting locking pin 80 by solenoid 75 during power up mode.

Figure 6:
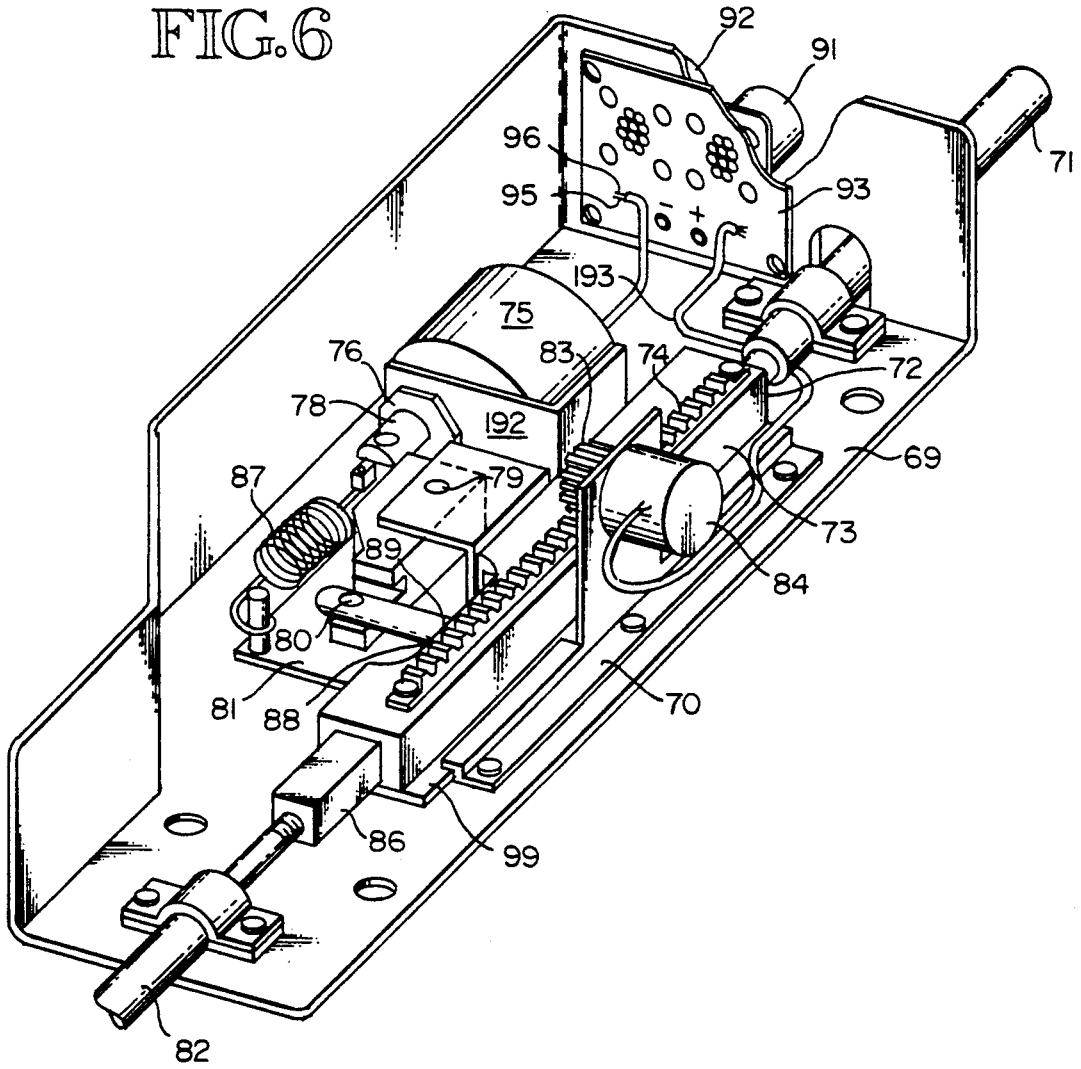
FIG. 6 shows a perspective view of the electro-mechanical transfer mechanism from transferring to and from electronic to manual push-pull cable engine control.

By manually moving the lever arm on control head 8, FIG. 1, which is attached directly by input cable 71, FIG. 6, to input slider 73, slider 73 can be moved in either direction allowing locking pin 80 to fall into locking pin engagement slot 88. Engagement of locking pin 80 into engagement slot 88 of output slider 86, locks input cable 71 to output cable 82. Output cable 82 can be attached directly to the engine's control means, but as shown in FIG. 7, the output cable 123 is attached directly to the input arm 126.

Referring further to FIG. 6, position potentiometer 84 which is a three turn precision potentiometer is secured to slider position potentiometer mounting bracket 70. Attached to the shaft of pot 84 is spur gear 83, the size and number of teeth has been selected such that three turn potentiometer 84 will rotate through 70 percent of its total resistance when travelling over three inches of the four inch long rack 74.

Position output cable 193 is attached to the position potentiometer 84 and routed to transfer interconnect printed circuit board 93. These wires are attached to printed circuit board 93 where they interconnect with transfer output plug 92. Also attached to printed circuit board 93 is transfer input socket 91, which connects to control head cable 11, FIG. 1. Continued reference to FIG. 1 will show that output plug 12 is attached to interconnect cable 20. This cable has plug 195 attached which connects into controller input socket 16 mounted on the controller 25.

In operation, when the electronic control system is turned on, a DC voltage will be sent from the controller, through cable 20 FIG. 1 to output plug 92 FIG. 6, where it connects through printed circuit board 93 to energize transfer relay 94. With transfer relay 94 energized, the normally open contacts are pulled in making contact with the common contact. The normally open contacts of relay 94 are attached to the positive terminal of terminal strip 90 by wire 97. The contacting of the normally open contact to the common contacts places the battery potential on solenoid wire 95. Wire 96 of solenoid 75, is attached to ground by wire 98. With a positive potential applied to solenoid 75, plunger 77 will move in bushing 76 and be attracted by the building magnetic flux generated by the induced current flowing into solenoid 75 coil. The movement of plunger 77 will cause solenoid rocker arm 78 to rotate on rocker arm pivot pin 79. This rotating action will pull locking pin 80 from locking pin engagement slot 88. This same rotating action of solenoid rocker arm 78 will expand locking pin return spring 87.

With locking pin 80 extracted from output slider 86, input slider 73 will move freely as input cable 71 is moved. This decoupling of input slider 73 from output slider 86 is one of the major objectives of this disclosure. By eliminating the output drag the control head lever moves easily and functions as an electronic control head.

Referring again to FIG. 6, the movement of the control head lever causes the inner core 72 of push-pull cable 71 to move. Attached to the inner core 72, is input slider 73 and mounted on upper surface of input slider 73, is slider gear rack 74. Any movement of the control head lever will be directly transmitted to input slider 73. Said movement will cause slider gear rack 74 to move linearly in the same plane as the input push-pull cable, which in turn will cause spur gear 83 to rotate. The rotation of potentiometer 84 shaft will produce a DC voltage proportional to the control lever position.

Attached to input slider 73 is a nylon base plate 99 which serves as the sliding surface when moved against the stainless steel mounting plate 69. Input slider 73 is retained in position and allowed to slide linearly by left slide track 85 and right slide track position potentiometer mounting bracket 70. Input slider 73 and base plate 99 forms a tunnel into which output slider 86 is able to freely move.

In FIG. 7, there can be seen a pictorial illustration of the mechanical portion of the conversion mechanism. As seen in FIG. 7, the major functional items of the mechanism are encased in a single enclosure to protect the integral elements that perform the mechanical conversion. The electro-magnetic clutch, which is made up of items 104, 105, 106, and 107, is the integral part which facilitates redundant engine control. It is through the disengagement of said clutch that the manual, human powered, conversion of one input motion is converted into two output motions to produce engine throttle and shift control. In addition, the engagement of said clutch and method by which said clutch couples the output of the gearhead mechanism 159 to clutch spur gear 102 into drive gear 128 facilitates the electronic and electromechanical conversion of one motor output to produce two linear output motions to control the engine's throttle and shift.

In the electronic mode of operation, electrical commands are coupled from the controller module through interconnect cable 165 to the power amplifier circuit board 114. Upon activation, a command signal from the microprocessor energizes power switch relay 113 to apply battery voltage through positive wire 118 to terminal 119, through wire 117, fuse 115 and wire 116 to the power amplifier circuit board 114 and relay 113.

The contact closure of relay 113 applies full battery potential through wire 110 to clutch coil 107. This induced current into coil 107 builds a magnetic field in clutch field assembly 106, through rotor assembly 105, to pull the moveable clutch armature plate 104 against rotor plate 105. The engagement of said clutch assembly facilitates coupling the output energy from the combined motor 101 and gearhead 103 output to clutch spur gear 102. The clutch assembly which is made up of items 105, 106, and 107 has clutch rotor 105 secured to motor shaft 120 by key 109 and locking set screw 108. Spur gear 102 is keyed and locked to clutch armature 104. Once the clutch is engaged any rotational movement which is commanded by the microprocessor through cable 165 to the power MOSFET driver to pulse motor input wire 111 or 112 will cause motor shaft 120 to rotate.

The clockwise or counterclockwise rotation of motor shaft 184 is coupled by the magnetic force generated by clutch coil 107. This pulling force attracts the clutch armature plate 104 against clutch rotor plate 105. The holding force of said clutch plates allows 125 inch pounds of rotation motor shaft torque to be applied through spur gear 102 to driven spur gear 128. Driven spur gear 128 is locked to throttle shaft 121.

When commanded to shift forward, the microprocessor, through power amplifier 114, servo drive motor 101, servo gearhead 103, and clutch gear 102, will rotate said clutch gear counterclockwise ninety degrees. This ninety degree rotation and direction of driven gear 128 is monitored by position sensor 100 through the rotation of sensor spur gear 166 which is attached to position sensor 100 shaft. Position sensor 100 and its associated gear is held in position by sensor position bracket 167. The position sensor 100 acts as the feedback element for the microprocessor enabling said microprocessor to monitor rotation and stop driven gear 128 when it reaches the commanded angle.

The ninety degree counterclockwise rotation of clutch spur gear 102, will cause driven gear 128 to rotate clockwise forty-five degrees. Said forty-five degree rotation occurs because driven gear 128 is two times larger in size than clutch spur gear 102.

Forty-five degrees clockwise rotation of driven gear 128 will cause throttle shaft 121 to also rotate clockwise forty-five degrees. The rotation of throttle shaft 121, causes throttle output arm 130 to rotate clockwise by the same forty-five degrees. Throttle shaft 121 will also cause throttle geneva cam driver 122 to rotate clockwise which, in turn, drives shift geneva cam follower 135 in the opposite or counterclockwise direction.

The rotation of said throttle shaft 121 shall also cause throttle spur gear 134 to rotate clockwise which, through its mesh, will cause input drive gear 129 to also rotate counterclockwise. Manual drive gear 129 has been modified by removing 139 degrees of the outer portion of the gear.

The counterclockwise rotation of manual drive gear 129 will rotate manual input shaft 127 counterclockwise which, in turn, causes manual conversion input arm 126 to rotate in the counterclockwise direction. The motion of manual conversion input arm 126 is mechanically coupled to input cable core 123 by quick release ball 125 and quick release connector 124 which through their physical movement, moves the manual lever at control helm thus giving visual feedback.

Figure 12:
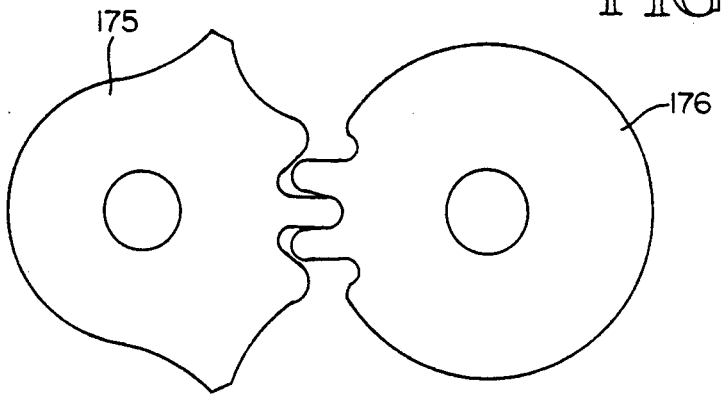
FIGS. 12–14 show a pictorial illustration of the geneva cams and their movement relative to input commands.

The rotation of throttle shaft 121, which started the above cycle of events, also causes throttle geneva cam driver 122 to rotate forty-five degrees clockwise. Referring to FIG. 12, it can be seen that in the neutral position, shift geneva cam follower 175 is meshed with throttle geneva cam driver 176 and detent roller mechanism is in neutral idle detent position. Geneva cams are a known and standard art for achieving an intermittent drive as is being disclosed in the shift cycle.

Figure 13:
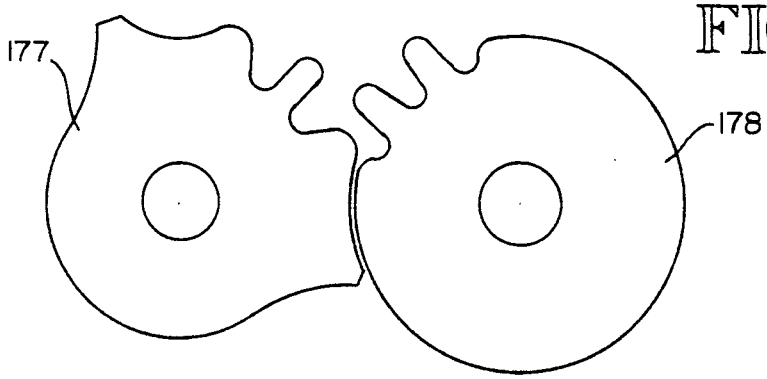

In this position the output control arms and their respected push-pull cables place the engine in idle and neutral. Throttle geneva cam driver 178, FIG. 13, which is driven by throttle shaft 121, FIG. 7, will rotate clockwise forty-five degrees as shown. The rotation of geneva cam driver 177, causes the counterclockwise rotation of shift geneva cam follower 177. At the same time detent roller mechanism 179 moves and detents into the forward shift position as shown in FIG. 13.

Figure 14:
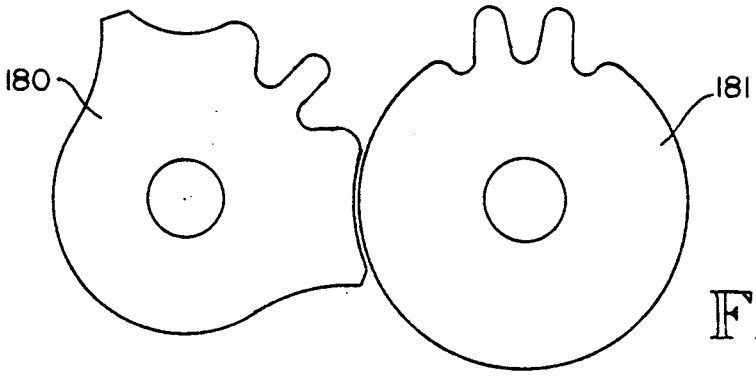

The continued rotation of geneva cam driver 178, shall be viewed in FIG. 14 wherein now defined geneva cam driver 181 has rotated a total of ninety degrees. The first forty-five degrees completes the shift cycle while the continued rotation of cam driver 181 increases the throttle. It should be noted, that the configuration of shift geneva cam follower 180, allows the continued rotation of cam driver 181 without the further rotation of geneva cam follower 180.

All throttle and shift operation is controlled by the rotation of throttle shaft 121. The clockwise rotation of throttle shaft 121 has several simultaneous actions. Previously discussed geneva cams 122 and 135, FIG. 7, discussed how these cams rotate and what engine function are controlled. As throttle geneva cam driver 122 rotates through its forty-five degrees rotation, throttle output arm 130 rotates at the same angular displacement.

During the rotation of throttle output arm 130, should throttle cable sheath 164 be fixed in one position, throttle output arm 130 would pull throttle cable core 185 and increase the throttle during the shift cycle. The throttle cannot be increased while the shift function is underway.

To eliminate this occurrence, throttle sheath positioning plate 132, FIG. 7, is installed on right servo panel 133. The objective of the throttle sheath positioning plate 132 is to move the outer sheath 164 while throttle arm 130 rotates through the forty-five degree arc required to complete the shift cycle.

Figure 9:
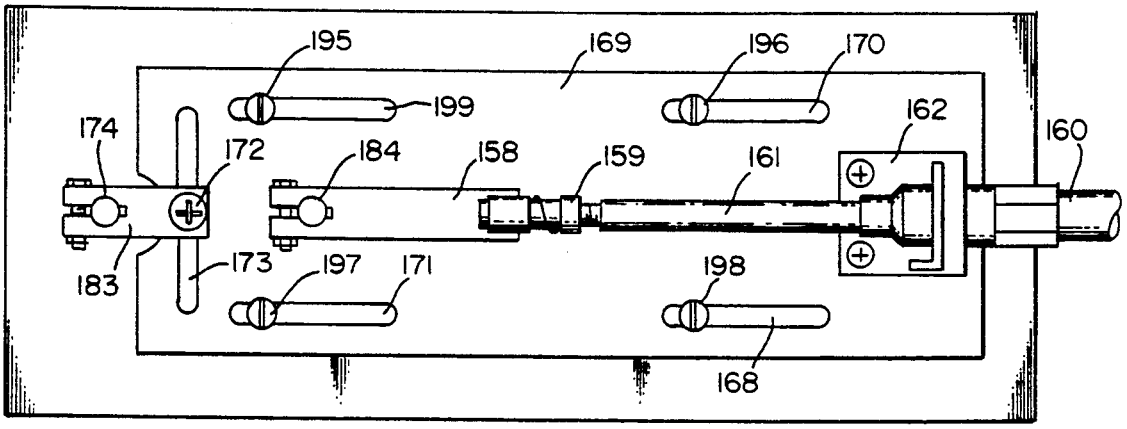
FIG. 9 shows a pictorial illustration of the throttle sheath moving mechanism.

To accomplish this requirement, reference FIG. 9, which is a pictorial illustration of the slide mechanism. Item 163 is now referenced as the right servo panel. Throttle sheath positioning plate is defined as item 169. Sheath positioning plate 169 is mounted on four guide pin positioning bearings 195, 196, 197, and 198 which are attached to right servo panel 169. Guide pin positioning bearing 131, FIG. 7 illustrates how the plate is retained. The retainers form a slide bearing surface, as well as, a bottom and top retaining lip to hold the sheath positioning plate 170, FIG. 9, in place.

In the neutral and idle position both the throttle output arm 158 and the sheath positioning arm 183 are pointed in the same direction or horizontal with side plate 163. As the throttle output shaft 184 starts rotating in the clockwise direction, throttle output arm 158 will rotate in a clockwise arc. As explained in previous discussions, shift output shaft 174 will rotate in a counterclockwise direction at the same angular rate as throttle shaft 184. Since the rate of rotation of each shaft is equal, a positioning slot, 173 is placed in sheath position plate 170. As sheath positioning arm 183 rotates, sheath positioning pin 172 will press against the inner lip of slot 173 and pull the complete positioning plate 169 toward shift output shaft 174. By moving the sheath positioning plate 169 at the same rate that throttle output arm 158 would be pulling the throttle cable core 161, assures that the throttle or engine RPM does not increase during the shift cycle.

To complete the shift cycle requires forty-five degrees rotation of throttle output shaft 184, of which directly drives shift output shaft 174 a corresponding number of degrees. As sheath positioning pin 172 pulls positioning plate 169 towards shift shaft 174, the plate will slide in tracks 170, 168, 171 and 199. Throttle cable 160 is secured to positioning plate 169 by throttle cable mounting bracket 162.

Once the shift cycle has been completed, sheath plate positioning pin 172 will hold positioning plate 169 in a fixed position so further rotation of throttle output arm 158 will pull throttle cable 160 inner core 161 and increase the engine's RPM. Quick release connector 159 provides the pivot point for throttle cable 160 as throttle arm 158 rotates through its arc.

Figure 11:
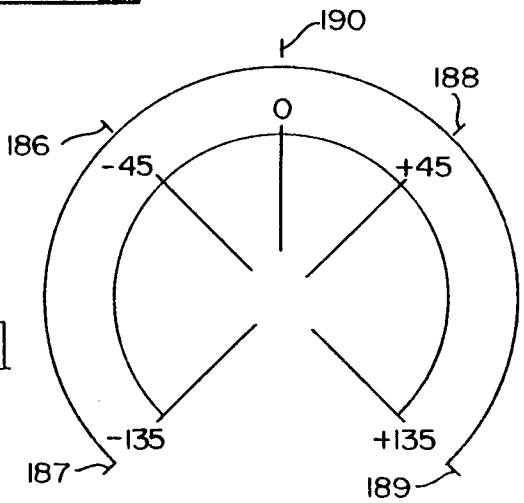
FIG. 11 shows a graphic illustration of the throttle arm rotation and its correlation with output functions.

The total arc that a throttle output arm 130 FIG. 7 must travel to control both the shift and throttle engine functions is defined by FIG. 11, which is an illustration showing engine function and required degrees of shaft rotation. Referring to FIG. 11, item 190 is defined as the zero degree position or idle and neutral. Previous discussions in the above disclosure, discussed relation between throttle geneva cam driver 122, FIG. 7, and shift geneva cam follower 135. FIGS. 12, 13, and 14 pictorially demonstrate the relation between the geneva cam and the engine functions.

FIG. 11 illustrates the number of degrees of throttle shaft and throttle arm travel to accomplish a shift function, items 186 and 188, as well as the number of degrees of rotation to complete a throttle function 187 and 189. The objective of FIG. 12 is to further illustrate the rotation of throttle arm 158, FIG. 10.

Figure 10:
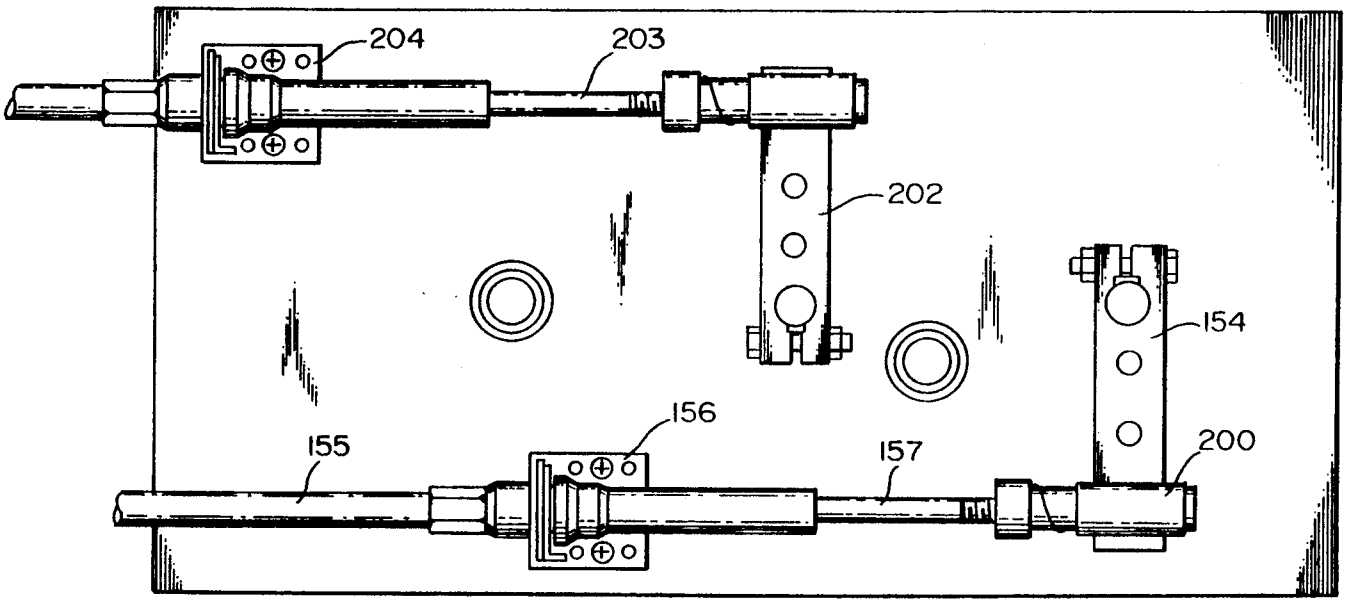
FIG. 10 shows a pictorial illustration of the input cable movement verses the shift output.

Referring to FIG. 10, a pictorial illustration of the left servo panel, the shift arm 154 will rotate forty-five degrees clockwise to shift the vessel in one direction, then forty-five degrees in the opposite direction to return to neutral. An additional forty-five degrees of counterclockwise rotation will shift the vessel to the opposite direction. The movement of the shift control lever 154 is coupled to the shift cable 155 by quick release 200. Shift cable mounting bracket 156 secures cable 155 to the side panel. Shift lever 154 motion is transmitted to the shift mechanism by shift cable core 157.

In the forgoing disclosure, and referring to FIG. 1, item 13, there is seen a manual push-pull cable which in a down power mode of operation is automatically coupled as discussed in the aforementioned disclosure to manually operated control head 8. One of the most important features and objectives of this disclosure is the automatic transference from electronic to manual and back to electronic engine control. A descriptive outline of electronic and mechanical engine controls has been disclosed. Let us now disclose what happens when power failure occurs and redundant manual controls are automatically coupled into the system.

It was disclosed in the FIG. 6 discussion, that locking pin 80 was held withdrawn from locking slot 88 by solenoid 75. It was further disclosed that with the loss of power, locking pin 80 would fall into locking slot 88, to mechanically couple input slider 73 to output slider 86 and manual push-pull cable 82.

These disclosed events have mechanically coupled the manual control lever 8, FIG. 1, to the input control arm 14 on conversion servo mechanism. Referring to FIG. 7, item 126, the manual input arm which has attached to it, by cable connector ball 125 and quick release 124, is manual input cable 123. Manual input cable 123 is the manual input in case of system failure whether that be a malfunction of the circuitry or a power loss.

In a down power manual operation as previously disclosed, the electro-magnetic clutch, which is made up of items 104, 105, 106, and 107, is de-energized and, therefore, allows the free turning of clutch spur gear 102. If clutch spur gear 102 freely turns, then throttle shaft 121 and manual input shaft 127 are allowed to rotate without restriction. Therefore, movement of manual input lever 126 will cause manual input shaft 127 to rotate. To have a single input means and convert this input to dual outputs of shift and throttle, the three inch stroke of input cable core 123 and the resultant ninety inch stroke of input cable core 123 and the resultant ninety degree rotation of manual input arm 126 must result in a 196 degree rotation of throttle shaft 121. To accomplish this, manual input gear 129 is a thirty tooth spur gear while throttle spur gear 134 is a 10 tooth spur gear. Therefore, 15 degrees rotation of manual drive gear 129 is multiplied by a factor of three and will result in 45 degrees rotation of throttle spur gear 134.

In operation, the manual input arm 126 is rotated 15 degrees. This 15 degree rotation will result in 15 degrees rotation of manual input gear 129 which , in turn, results in 45 degrees rotation of throttle spur gear 134. This resultant rotation is coupled through the geneva cams 122 and 135 to rotate shift arm 201 and complete the shift cycle. Any further movement of manual input arm 126 will result in the throttle being increased as disclosed previously.

In a cold engine start situation the engine's throttle will be required to be increased, but the shift must remain in neutral. In view of the fact that only single inputs, whether manual or electronic, are used to accomplish the dual outputs of shift and throttle, the shift function must be disengaged to facilitate throttle movement during engine start.

Figure 8:
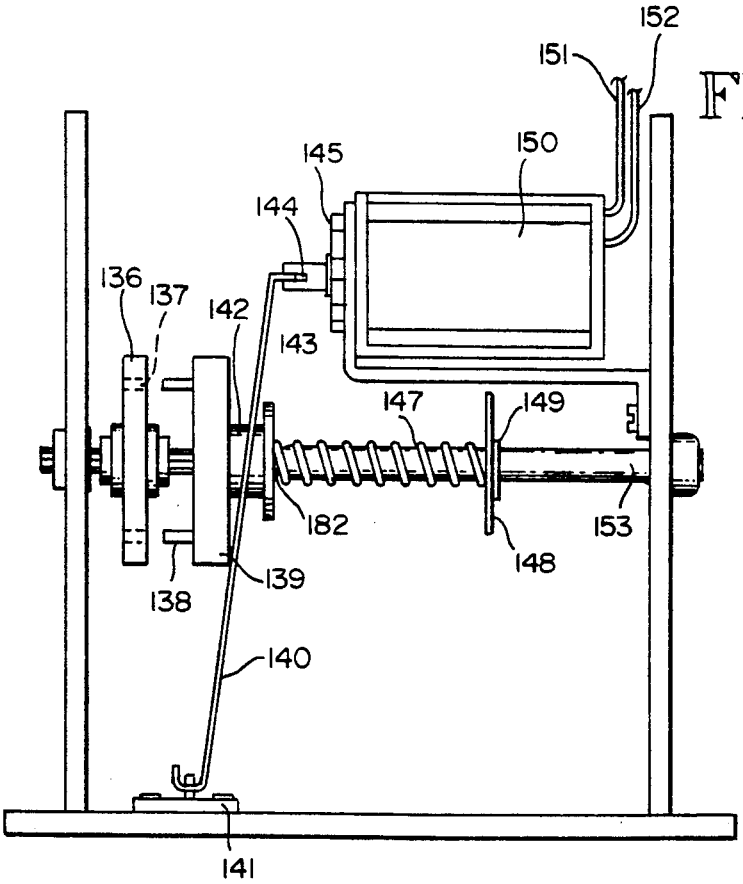
FIG. 8 shows a pictorial illustration of the neutral start mechanism.

To facilitate the above statement, refer to FIG. 8, a pictorial illustration which shows how the shift function is decoupled. The shift geneva cam follower, its function disclosed previously, is shown as item 136. The geneva cam follower is mounted on a bearing allowing free rotation when disengaged. To disengage the shift function, shift locking plate 139 and its associated locking pins 138 must be withdrawn from the shift geneva cam 136 and its associated Oilite bearings seats 137. Shift locking plate 139 has been designed to slide on the shaft spline 182.

In the locked mode of operation, return spring 147 pushes shift locking plate 139 and locking pins 138 so that they engage into bearing seats 137, locking together rotational movement of shift geneva cam 136 and shift locking plate 139. Shift locking plate 139 is attached to shift drive shaft 153 by spline 182 wherein locking plate 139 is allowed to slide within the spline but is locked on rotational movement. Therefore, in the locked mode, any rotation of geneva cam follower 136 will result in a like rotation of shift locking plate 139, which, in turn, through the action of the spline 182 will rotate shift drive shaft 153 and complete the shift function.

To disconnect the shift function, decoupling solenoid 150 must be energized. To energize solenoid 150 wire 152 is attached to a ground potential. Wire 151 must have a positive potential applied through a switch. Pressing a single pole switch applies $\pm 12$ volts to the coil of solenoid 150 wherein a magnetic field is generated to attract solenoid plunger 144 and pull said plunger into and seat said plunger inside the solenoid. Solenoid plunger 144 is attached to the decoupling yoke 140 by roll pin 143. The decoupling yoke is a U shaped device and fits around the throw out bearing section 142 of the shift locking plate 139.

Decoupling yoke 140, FIG. 8, pivots on pivot point 141 allowing decoupling yoke to move when solenoid plunger 144 is attracted by energized solenoid 150. The movement of yoke 140 presses yoke 140 against throw out bearing 142 to move locking plate 139 on spline 182. The movement of shift locking plate 139 compresses return spring 147 which is held in place by spring retaining washer 148 and "E" clip 149. Solenoid 150 is mounted in place by solenoid mounting bracket 146 and held in place by locking nut 145. The position of solenoid 150 is such that solenoid plunger 144 is bottomed in seat of solenoid 150 at that point where yoke 140 has withdrawn locking pins 138 from bearing seats 137, thus allowing geneva cam follower 136 to rotate freely on shaft 153.

Figure 15:
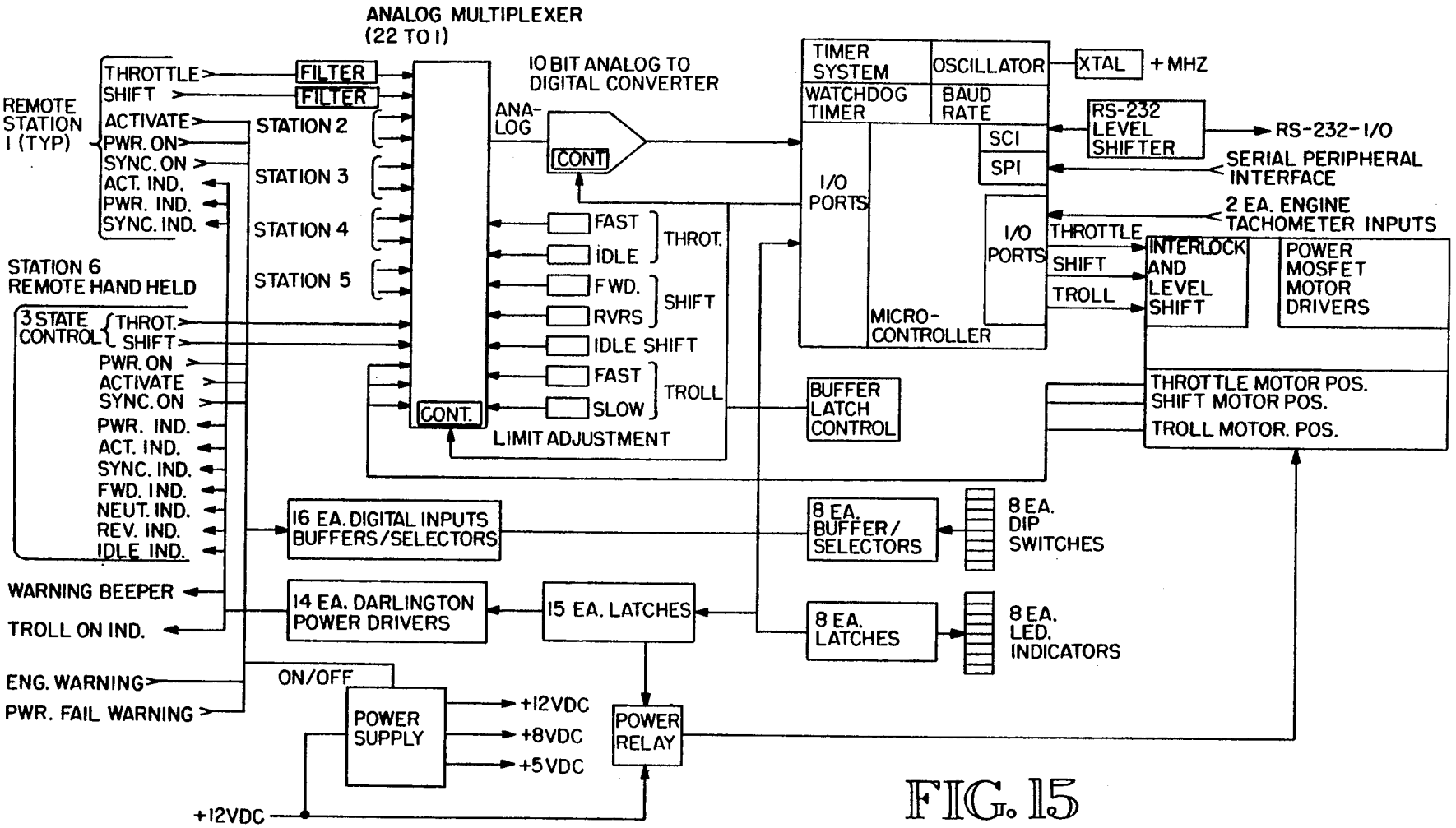
FIG. 15 shows an electronic schematic of the electro-mechanical servo/controller.
Figure 16:
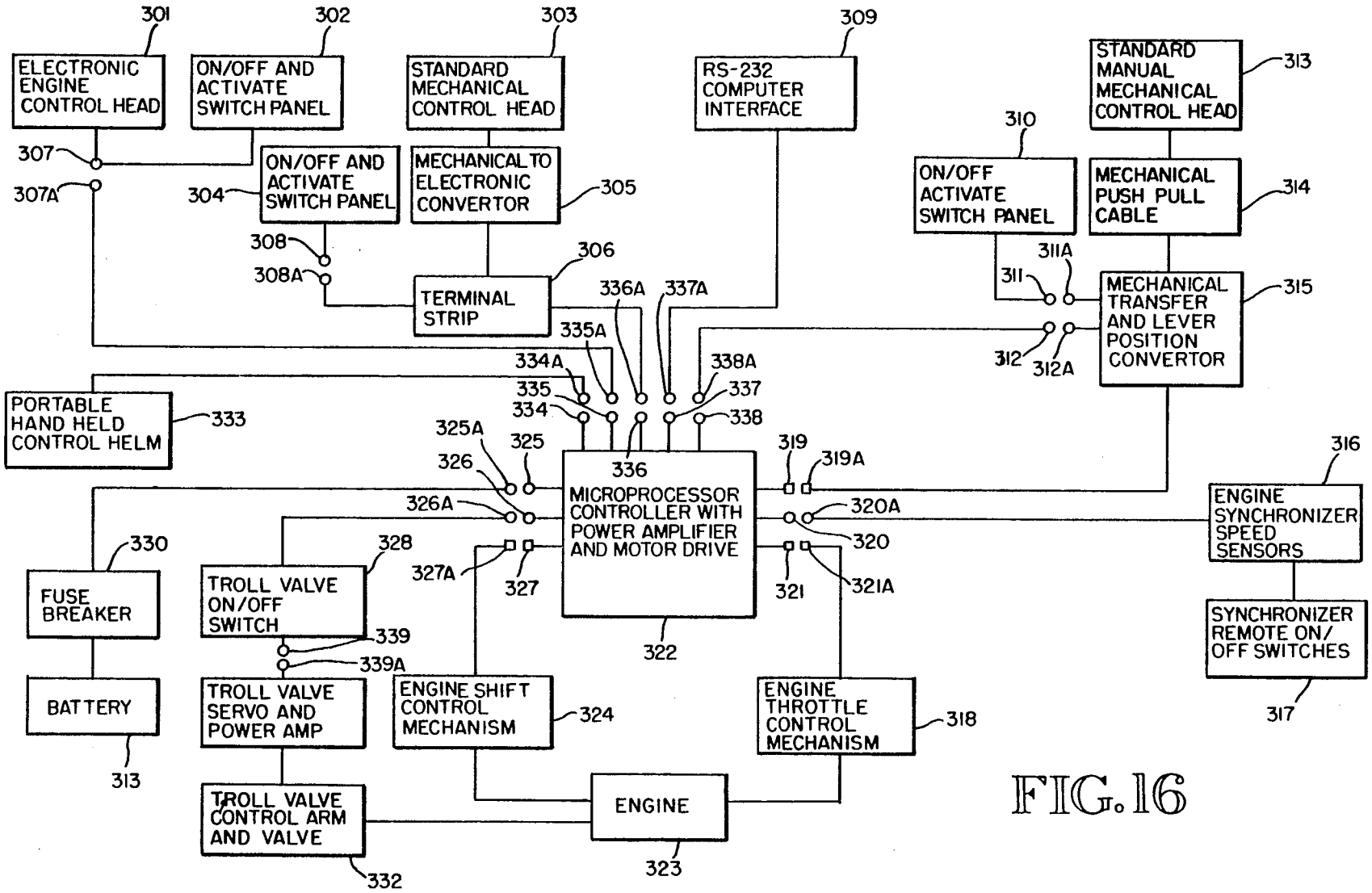
FIG. 16 show an electronic schematic of the FIG. 1 system.

FIG. 15 is a block diagram of the electronic control module which contains the microcontroller and its associated interface circuits. FIG. 16 is a block diagram of typical external circuitry that interfaces with the electronic control module of FIG. 15.

The circuit design and the parts utilized in this design are of standard design with parts purchased from distribution. The circuit is configured to meet the needs of the product operational requirements while the software has been designed to meet the needs of human interface, operation and product reliability.

Referencing FIG. 15 there is seen an illustrated block diagram of the basic input, output and interface circuits controlled by the microcontroller. Analog information representing throttle and shift commands are brought into the microcontroller through analog multiplexers along with limit set points and motor position signals. These are converted from analog to 10-bit binary by analog to digital converter. Under software control the microcontroller commands throttle movement, transmission shifting, both within defined limits as well as displays these limits through visual indicators. Power failures, current limits, jams and other possible failures are monitored by the software and displayed visually and through alarms. Other functions such as transmission troll control, automatic engine synchronization, high idle shift and cold engine start are under software control. Software facilitates the use of dual or single lever control as well as digital remote portable control. Under software control and standard communication lines such as RS-232 the microcontroller is able to communicate with other computer controlled devices such as autopilots and etc.

The MC68HC705C8 microcontroller is a member of the M68HC05 family of 8-bit microcontroller unit. It is a 4 mhz, high performance MCU having parallel input-/output capability with onboard RAM and ROM, serial communication interface (SCI), serial peripheral interface (SPI), watch dog timer (COP), and many other standard features which lend themselves to engine control. The microcontroller is programmed in the standard manner to provide maximum engine performance, and ease of human operation with operational alarms to alert of system or part failures.

Referencing FIG. 1, there is seen a lever control head item 1, which contains a set of potentiometers which convert the mechanical lever movement, represented by item 26, into an analog signal which is proportional to the angular position of said lever. This analog input voltage is fed into the Remote Station 1 throttle and shift inputs as shown in FIG. 15. Remote Station 1 exemplifies the typical input station while stations 2 through 5 are optional or additional station inputs. All control stations have the same inputs and outputs and are interchangeable. A sixth station is also present but its outputs and inputs are digital and have been designated for the portable remote handheld control.

The analog throttle and shift signals of remote station 1 or other like stations are filtered coming into the input of the module with a low pass filter network which has been designed to roll off any frequency above 50 hz., thus reducing any high frequency noise which may be present on the incoming lines.

Analog throttle and shift signals pass through the filter network into a low power complementary MOS analog multiplexers/demultiplexers which function as digitally controlled analog switches. An on-chip address decoder selects the appropriate input by means of a binary code. All channels may be deactivated by an enable/disable pin. A total of 22 input analog signals are switched by the microcontroller onto a common output line. Those analog input signals which are switched are throttle and shift lever position from six control stations, throttle motor, shift motor and troll motor position as well as adjustable limit set points for throttle, shift, troll and high idle limit.

Analog signals are acknowledged by the microcontroller and switched into the 10 bit analog-to-digital convertor under software control. The analog-to-digital converter (ADC) translates the analog input voltage from the control levers, the motor position feedback and each functions limit into a quantitized digital value. A 10 bit ADC has been designed in order to gain proper servo motor position resolution. the aforementioned ADC uses the Successive Approximation Register (SAR) conversion technique. To achieve proper dynamic performance a sample and hold technique is used at the input to decrease the effective aperture time thus decreasing susceptibility to noise and voltage fluctuations.

A brief and simplified descriptive explanation of the systems operation can be outlined by beginning with the turn "on" of the control system. The system can be turned "on" at any control station. This feature is present because the operator may want to operate the vessel from any station. By pressing the "on" switch at the selected station, a logic low is placed on the pwr. on or sense terminal of the power supply causing the input flip flop to change state pulling in a power relay to switch the battery voltage into the power supply circuits. With battery voltage present the precision regulators within the power supply will output a +12 VDC, +8 VDC and +5 VDC output. The regulated +5 VDC is applied to all the computer circuits defined within FIG. 15.

With +5 VDC available, an analog signal which represents lever position, motor position and/or limit position is present at the input of the analog multiplexer/demultiplexer. At initial turn-on, the system must be configured to meet the needs of the user, the vessel, the input controls and the required limit set points.

To facilitate this configuration, the user has to select either a single or dual lever control. Single lever control means both shift and throttle functions are on one lever, while dual lever means one lever controls the shift function while the second lever controls the throttle function. The microcontroller, through its software, is instructed which control lever configuration is being used by the setting of dip switch 1 in the 0 or 1 position. Position 0 is single lever and 1 is dual lever control.

The second step in configuring the system is to set the limit or travel of each of the throttle, shift or troll servos. This is accomplished by setting electronic limits. The mechanical servo output is a push pull cable which attaches the servo to the engine function as defined previously within the text of this application. The installer must physically position, for example purposes, the throttle to maximum throttle or the fast position. This mechanical position is represented by an analog output signal which is defined as the throttle motor position. The microcontroller, under software supervision, will convert this analog throttle motor position signal into a 10-bit binary coded signal by multiplexing that specific analog position signal into the ADC. The output of the ADC is a 10-bit binary code which will be written into an input port of the microcontroller.

The throttle fast limit adjustment, a potentiometer, must be rotated to the point where its resistance and, in turn, its analog voltage will be equal to the throttle motor position signal written into the microcontroller in the above discussion. Under software and microcontroller control, the throttle fast limit analog voltage will be converted into a 10-bit binary coded signal, written into an input port of the microcontroller and compared to the previously written throttle motor position. When these binary signal are equal, the microcontroller will output a command to one of the 8 latches and lite the second LED indicator defining the fast limit set point. Each limit adjustment is set in the same manner as described above and sets the parameters of operation.

When all limit adjustments have been set, the system is shut "off" by pressing the power "on" switch. The system is then turned "on" by pressing the same power "on" switch. With power turned "on" the microcontroller will re-initialize itself, defining what type of lever control is used, what options are used and what is the binary position of all adjustable limits.

The throttle and shift lever controls have a fixed rotational angle of 140 degrees and, therefore, a fixed voltage swing. This angle of rotation is programmed into the software as a fixed number. The limit adjustments are a variable and, therefore, must be linearized so the standard travel of the control lever will yield a know operator feel of throttle. In other words, a 70 degree movement or 50% of the total travel of the control lever will always yield 50% servo throttle travel whether the travel of the servo is 1 inch or 3.0 inches.

Once the initial setup is completed and the system ready for operation the system is turned "on" as previously discussed. With the system turned "on" the operator must then gain control at a specific station. To gain control at any control station the operator first positions the control lever(s) in the same position as the motor(s) position. For example, let us assume the engine and, therefore, the servos throttle position is at idle and the shift position of the transmission is at neutral. Let us further assume the controls used are dual levers. In this mode of "on" operation, which is defined as standby, the operator positions the control levers to idle and neutral. In doing so the microcontroller, using the throttle and shift motor position as the reference, compares the lever(s) position against the motor(s) position.

When these 10-bit binary signals are equal the software instructs the microcontroller to output a command to one of the 15 latches, a blink on and off at a one second rate to activate indicator on the station requesting control. To complete the request for station control the operator must then press the activate switch on the station gaining control, which sends a logic 1 instruction to the microcontroller who then acknowledges that station as the control station. When the microcontroller acknowledges that a station has taken control it will change the blinking command to a latched "on" command lighting the activate indicator continuously. The software instruction will also command the microcontroller to energize a power relay which will supply the battery voltage, or +12 VDC to the power MOSFET motor driver circuits. This +12 VDC battery voltage is also applied to the clutch, energizing the clutch coupling the servo motor to the output control arm.

Once the control station has gained control, that station's control lever position serves as the reference. To change the engine's RPM, the control station throttle lever is moved forward, for example 10 percent. That movement will produce a 10-bit binary signal which creates a difference between the control lever position and the throttle motor position. The software will calculate the difference and instruct the microcontroller to increase the throttle servo position. The microcontroller outputs a PWM signal which is connected into the power motor driver circuit through an interlock and level shifting circuit. The level shifting circuit translates the 5 volt logic signal into a 12 volt signal suitable to interface with the drive circuits. The output of the drive circuits are coupled into a TMOS power MOSFET H-bridge power circuit. These power circuits are packaged for 8 amp operation and are ideal for servo motor drive application.

The commanded signal is applied to the upper leg of the bridge, which consists of the P-channel power MOSFETs, causing the servo motor to rotate and increase the throttle. The throttle servo increase causes the motor position potentiometer to output an increasing analog voltage which continues to increase as the servo rotates until it is equal to the translated 10-bit code from the throttle lever input command.

The software has been designed and written in such a manner that the transmission cannot be shifted unless the throttle is in an idle position as defined by the idle limit adjustment set point. Should the operator desire to shift the transmission at a higher RPM than the true engine idle position, he may do so by activating a high idle shift function, a variable set point, which was set during set up procedure and is under software control. By pressing the activate switch a second time the software will acknowledge this command, indicating this acknowledgment by blinking the activate indicator in a two on, two off 1 second sequence. To operate the shift function while in the high idle mode of operation the operator will bring the throttle down to the desired shift RPM and initiate a shift function under software control. The transmission can be shifted at any time the RPM is within the window set by the lower or true idle point and the higher idle shift set point. To deactivate the high idle shift function, the operator presses the activate switch again, at which time the microcontroller will place the shift point back at the true engine idle point and change the activate lite back to a steady on condition.

The hardware and software has been designed to accept RPM pulse data and, when commanded, will operate in an automatic engine synchronization mode. The hardware and software on the controller module is designed to accept two engine inputs which are logic 1 pulses for each rotation of the engines. The software then multiplies this pulse data into a frequency which is representative of the RPM of both engines. To implement the synchronization function, during setup procedures dip switch 2 must be placed in the 1 position. With dip switch 2 in the 1 position, the operator will push a separate synchronizer "on" switch. The pressing of the switch will generate a logic 1 which will be acknowledged by the microcontroller and within three seconds the operator must activate that function by pressing the activate switch on the control station in command. When activated, the software will instruct the microcontroller to the lite the lamp in the command stations synchronizer indicator.

In operation the controller module which has dip switch 2 in the 1 position will be defined as the slave engine and when activated will follow the master engine. The operator will move the master engine's throttle lever, increasing that engine's RPM. This increase in RPM will create a difference in RPM with the software commanding the slave microcontroller to increase the throttle of the slave engine to equal the master.

Under software control the slave servo will be driven by a varying pulse width of the PWM. By monitoring the rate of correction the software will vary the width of the drive pulse sufficiently to move the engine's throttle in the increase direction. Because of governor spring action the pulse width required to decrease RPM may be less than the increase direction. The software will automatically compensate by changing this pulse width so 5 RPM engine synchronization can be achieved.

To deactivate the automatic engine synchronizer function the operator presses the sync. "on" switch. The microcontroller will acknowledge this command by extinguishing the sync indicator lamp and the activate lamp on the slave control station. To gain throttle lever control at the slave station the operator will position the throttle lever to the same position of the engine, the software will acknowledge this by blinking the activate lamp, at which time the operator will press the activate switch gaining control. The software will acknowledge this command by commanding the microcontroller to stop blinking the activate lamp and drive it fully on.

A troll function software and hardware are present should the vessel under control exceed the minimum speed limit when at idle. This troll function is operational only on transmission equipped with troll valves. In this mode of operation the transmission is slipped by by-passing transmission fluid. The slippage is accomplished by changing the position of a valve and is accomplished with a separate servo which is mechanically coupled to the valve. To initialize this function, dip switch 7 is placed in the 1 position. With proper inconnections, the operator may activate the troll function only in the true throttle idle position. By pressing the troll "on" switch and within three seconds pressing the station in control activate switch, the microcontroller, under software control, will acknowledge that command and initialize that function. In initializing the troll function the microcontroller will command that the troll indicator be lit indicating that function is operational. By moving the throttle lever forward the software will not increase the throttle and, therefore, the engine RPM, but will command the troll servo to move the troll valve lever on the transmission proportionally and slow the vessel down. To deactivate the troll function the operator must place the throttle lever in the idle position and press the troll "on" switch a second time, deactivating the troll function, reinitializing the throttle function and extinguishing the troll indicator lamp.

In single lever operation a cold engine start function is accessible. With the system "on" and before starting the engine, the operator will press and hold down the activate switch while moving the control lever from neutral through the shift function to the idle position. The software will instruct the microcontroller to not shift the transmission but only allow throttle operation.

The operator may then release the activate switch and increase the throttle as necessary for starting the engine. With the engine running and warmed up the operator may return the control lever to neutral and idle at which time the software will reset the cold engine start function and place the control station in normal operation.

Several software protections are designed into the system to protect against failures in operation and components. Operational failures such as jams, which stop the servo from completing a command, are acknowledged in two ways. One method of protection is a current limit signal transmitted to the microcontroller from the power MOSFET motor drive circuit. This logic 1 signal will interrupt the motor command stopping the servo. The microcontroller will alert the operator by blinking both the power "on" and activate "on" indicators at a ½ second rate. If the installation has a beeper installed, an audible sound will alert the operator.

A second method of protection is a 3 second time out. If an instruction is not completed within a three second time period the microcontroller will stop that function and alert the operator by blinking the power "on" and activate "on" indicators.

Should a software failure occur, the watchdog timer will alert the operator of this failure by shutting the system "off" and alerting the operator with an audible beeper.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. An electro-mechanical engine control system for the shift and throttle functions of marine engines which comprises an electronically-controlled mechanical servo control means coupleable to the shift and throttle functions of a marine engine; a manually-operable ship-board operator engine shift and throttle control means; and an electro-mechanical transfer means coupled to the operator control means and to the servo control means for transferring operator shift and throttle settings to said servo control means, said transfer means being both electronically and mechanically coupled to said servo control means and being constructed and arranged whereby said transfer means will mechanically actuate said servo control means in the absence of electrical power and will electronically actuate said servo control means when electrical power is applied to said servo control means; said transfer means including coupling means preferentially electrically-coupling said operator control means to said servo control means, said coupling means being so constructed and arranged to automatically mechanically-couple said operator control means to said servo control means in the event of electrical power failure and to automatically electrically-couple said operator control means to said servo control means when electrical power is restored.

2. The system of claim a wherein said transfer means comprises a push-pull cable mechanism coupling said operator control means to said servo control means, said coupling comprising an input push-pull cable connected to said operator control means, an output push-pull cable connected to said servo control means; and wherein said coupling means is interposed in said push-pull cable mechanism whereby said push-pull cable mechanism is rendered inoperative when electrical power is applied to said servo control means and the operator control mean setting is electronically-transmitted to said servo control means, and whereby said push-pull cable mechanism is rendered operative in the absence of electrical power.

3. The system of claim 2 wherein said servo control means includes mechanical positioning means to position said output push-pull cable whereby, in the absence of electrical power, said input-to-output coupler means will couple the input push-pull cable to said output push-pull cable for mechanical control of said servo control means from said operator control means.

4. The system of claim 1 including a second manually-operable ship-board operator engine shift and throttle control means coupleable to the shift and throttle functions of a marine engine; and an electronic conversion means coupling said servo control means to said second operator control means, said conversion means being so constructed and arranged whereby manual settings made at said second operator control means are converted to electrical signals and the converted signals transmitted to said servo control means for control thereof; said conversion means including linkage means and electrical signal producing means, said linkage means being mechanically coupled to said second operator control means and to said electrical signal producing means, and said electrical signal producing means being electrically coupled to said servo control means, whereby manual settings of said second operator control means will be transmitted by said linkage means to said electrical signal producing means for producing electrical signals proportional to shift and throttle settings of said second operator control means and such signals will be transmitted to said servo control means.

5. The system of claim 4 including station activation means coupled to said second operator control means and to said servo control means, said station activation means being so constructed and arranged whereby said second operator control means can become functional only when the manual settings thereof are adjusted to match then-existing shift and throttle settings of said servo control means, and whereby the shift and throttle settings of said servo control means need not be adjusted to any predetermined setting prior to activation of said second operator control means.

6. The system of claim 1 including a second manually-operable electronic ship-board operator engine shift and throttle control means coupleable to the shift and throttle functions of a marine engine; and station activation means coupled to said second operator control means and to said servo control means, said station activation means being so constructed and arranged whereby said second operator control means can become functional only when the manual settings thereof are adjusted to match then-existing shift and throttle settings of said servo control means, and whereby the shift and throttle settings of said servo control means need not be adjusted to any predetermined setting prior to activation of said second operator control means.

7. An electro-mechanical engine control system for the shift and throttle functions of marine engines which comprises an electronically-controlled mechanical servo control means coupleable to the shift and throttle functions of a marine engine; a manually-operable ship-board operator engine shift and throttle control means; and an electro-mechanical transfer means coupled to the operator control means and to the servo control means for transferring operator shift and throttle settings to said servo control means, said transfer means being both electronically and mechanically coupled to said servo control means and being constructed and arranged whereby said transfer means will mechanically actuate said servo control means in the absence of electrical power and will electronically actuate said servo control means when electrical power is applied to said servo control means;

said transfer means comprising a push-pull cable mechanism coupling said operator control means to said servo control means, said coupling comprising an input push-pull cable connected to said operator control means, an output push-pull cable connected to said servo control means, and an input-to-output coupler means; an electronically-controlled coupling mechanism interposed in said push-pull cable mechanism whereby said push-pull cable mechanism is rendered inoperative when electrical power is applied to said servo control means and the operator control means setting is electronically-transmitted to said servo control means, and whereby said push-pull cable mechanism is rendered operative in the absence of electrical power.

8. The system of claim 7 wherein said servo control means includes mechanical positioning means to position said output push-pull cable whereby, in the absence of electrical power, said input-to-output coupler means will couple the input push-pull cable to said output push-pull cable for mechanical control of said servo control means from said operator control means.

9. An electro-mechanical engine control system for the shift and throttle functions of marine engines which comprises an electronically-controlled mechanical servo control means coupleable to the shift and throttle functions of a marine engine; a manually-operable ship-board operator engine shift and throttle control means; and an electronic conversion means coupling said servo control means to said operator control means, said conversion means whereby manual settings at said operator control means are converted to electrical signals and the converted signals transmitted to said servo control means for control thereof; said conversion means including linkage means and electrical signal producing means, said linkage means being mechanically coupled to said second operator control means and to said electrical signal producing means, and said electrical signal producing means is electrically coupled to said servo control means, whereby manual settings of said second operator control means will be transmitted by said linkage means to said electrical signal producing means for producing an electrical signal proportional to shift and throttle settings of said second operator control means and transmitting such signal to said servo control means.

10. The system of claim 9 wherein said conversion means is incorporated into the control head of a manual lever-control operator control means and is constructed and arranged with respect to said manual lever-control whereby the position of the lever control is translated into electrical signals for transmission to said servo control means.

11. An electro-mechanical engine control system for the shift and throttle functions of marine engines which comprises an electronically-controlled mechanical servo control means coupleable to the shift and throttle functions of a marine engine; a first manually-operable ship-board operator engine shift and throttle control means; an electro-mechanical transfer means coupled to the first operator control means and to the servo control means for transferring operator shift and throttle settings to said servo control means, said transfer means being both electronically and mechanically coupled to said servo control means and being constructed and arranged whereby said transfer means will mechanically actuate said servo control means in the absence of electrical power and will electronically actuate said servo control means when electrical power is applied to said servo control means; a second manually-operable ship-board operator engine shift and throttle control means; and an electronic conversion means coupling said servo control means to said second operator control means, said conversion means being so constructed and arranged whereby manual settings at said second operator control means are converted to electrical signals and the converted signals transmitted to said servo control means for control thereof;

said transfer means comprising a push-pull cable mechanism coupling said first operator control means to said servo control means, said coupling comprising an input push-pull cable connected to said first operator control means, an output push-pull cable connected to said servo control means, and an input-to-output coupler means; an electronically-controlled coupling mechanism interposed in said push-pull cable mechanism whereby said push-pull cable mechanism is rendered inoperative when electrical power is applied to said servo control means and the first operator control means setting is electronically-transmitted to said servo control means, and whereby said push-pull cable mechanism is rendered operative in the absence of electrical power.

12. An electro-mechanical engine control system for the shift and throttle functions of marine engines which comprises an electronically-controlled mechanical servo control means coupleable to the shift and throttle functions of a marine engine; a first manually-operable ship-board operator engine shift and throttle control means; an electro-mechanical transfer means coupled to the first operator control means and to the servo control means for transferring operator shift and throttle settings to said servo control means, said transfer means being both electronically and mechanically coupled to said servo control means and being constructed and arranged whereby said transfer means will mechanically actuate said servo control means in the absence of electrical power and will electronically actuate said servo control means when electrical power is applied to said servo control means; a second manually-operable ship-board operator engine shift and throttle control means; and an electronic conversion means coupling said servo control means to said second operator control means, said conversion means being so constructed and arranged whereby manual settings at said second operator control means are converted to electrical signals and the converted signals transmitted to said servo control means for control thereof;

said conversion means being incorporated into the control head of a manual lever-control operator control means and is constructed and arranged with respect to said manual lever-control whereby the position of the lever control is translated into electrical signals for transmission to said servo control means.

* * * * *